US008602711B1

(12) United States Patent
Nash et al.

(10) Patent No.: US 8,602,711 B1
(45) Date of Patent: Dec. 10, 2013

(54) COMBINATION TENNIS BALL CART AND MOWER

(71) Applicants: Novak Nash, Canoga Park, CA (US); Richard S. Kay, Calabasas, CA (US); Richard L. Miller, Dix Hills, NY (US)

(72) Inventors: Novak Nash, Canoga Park, CA (US); Richard S. Kay, Calabasas, CA (US); Richard L. Miller, Dix Hills, NY (US)

( * ) Notice: Subject to any disclaimer, the term of this patent is extended or adjusted under 35 U.S.C. 154(b) by 0 days.

(21) Appl. No.: 13/751,123

(22) Filed: Jan. 27, 2013

(51) Int. Cl.
*B60P 1/36* (2006.01)

(52) U.S. Cl.
USPC ..... 414/440; 414/441; 294/19.2

(58) Field of Classification Search
USPC ..... 414/439–441; 294/19.2
See application file for complete search history.

(56) References Cited

U.S. PATENT DOCUMENTS

| | | | | | |
|---|---|---|---|---|---|
| 3,102,647 | A * | 9/1963 | Bonney | 414/440 |
| 3,485,398 | A | 12/1969 | Offner | |
| 3,777,732 | A | 12/1973 | Holloway et al. | |
| 3,823,838 | A * | 7/1974 | Gustafson et al. | 414/440 |
| 3,913,552 | A | 10/1975 | Yarur et al. | |
| 4,221,524 | A * | 9/1980 | Morris | 414/439 |
| 4,383,695 | A | 5/1983 | Ray | |
| 4,550,465 | A * | 11/1985 | Chrisley | 15/84 |
| 4,735,544 | A | 4/1988 | Stotts | |
| 5,056,786 | A | 10/1991 | Bellettini et al. | |
| 5,147,100 | A | 9/1992 | Frankel | |
| 5,301,991 | A | 4/1994 | Chen et al. | |
| 6,079,930 | A * | 6/2000 | Valdes-Rodriguez | 414/440 |
| 6,340,188 | B1 | 1/2002 | Cuti | |
| 8,075,030 | B2 * | 12/2011 | Pearson et al. | 294/19.2 |
| 2006/0082171 | A1 | 4/2006 | Olmstead | |
| 2011/0262259 | A1 | 10/2011 | Zats | |
| 2012/0093621 | A1 * | 4/2012 | Reyes | 414/507 |
| 2013/0064631 | A1 * | 3/2013 | Leyco et al. | 414/439 |

* cited by examiner

*Primary Examiner* — Jonathan Snelting
(74) *Attorney, Agent, or Firm* — Richard L. Miller

(57) ABSTRACT

A cart that collects tennis balls on the ground when manually pushed by a user and stores the tennis balls once collected. The cart includes a housing, a gathering assembly, a conveyor assembly, and a receptacle. The housing is manually pushed by the user. The gathering assembly is operatively connected to the housing, and gathers the tennis balls on the ground. The conveyor assembly is operatively connected within the housing. The receptacle is disposed against the housing, and stores the tennis balls elevated thereto by the conveyor assembly that have been gathered by the gathering assembly.

35 Claims, 7 Drawing Sheets

COMBINATION TENNIS BALL CART AND MOWER

1. BACKGROUND OF THE INVENTION

A. Field of the Invention

The embodiments of the present invention relate to a cart, and more particularly, the embodiments of the present invention relate to a cart for collecting tennis balls on the ground when manually pushed by a user and for storing the tennis balls once collected.

B. Description of the Prior Art

Numerous innovations for tennis ball throwers and retrievers have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention.

(1) U.S. Pat. No. 3,485,398 to Offner.

U.S. Pat. No. 3,485,398—issued to Offner on Dec. 23, 1969 in U.S. class 414 and subclass 440—teaches a tennis ball pick-up and collecting machine. A conventional hand-pushed lawn mower, including side frames, belts reel assembly, wheels, rollers, cutter bar, and handle, is modified by removing the cutter bar and replacing it by a tennis ball guide plate. The guide plate includes a front portion located near ground level between the reel assembly and roller, and a rear portion extending from the front portion, over the roller to a rearward location, and receiving a tennis ball collecting box thereon. A repeller plate is arranged with respect to a top, rear portion of the reel assembly for intercepting and redirecting the flow of air propelled around the outside of the reel assembly when the reel assembly is caused to rotate.

(2) U.S. Pat. No. 3,777,732 to Holloway et al.

U.S. Pat. No. 3,777,732—issued to Holloway et al. on Dec. 11, 1973 in U.S. class 124 and subclass 78—teaches a ball throwing machine that ejects tennis balls in regular sequence and at a controlled velocity to simulate tennis service from an opponent during practice sessions. The machine is adapted to intermittently vary the vertical and horizontal angles of ball ejection thereby providing game-like situations. An anti-all jamming device is located in the base of a ball hopper. The machine has structure for permitting rotation of the subframe about a vertical axis to vary the horizontal angle of discharge of a projectile. As an alternate method for varying the horizontal angle of discharge of a projectile, the subframe may be oscillated about a vertical axis.

(3) U.S. Pat. No. 3,913,552 to Yarer et al.

U.S. Pat. No. 3,913,552—issued to Yarer et al. on Oct. 21, 1975 in U.S. class 124 and subclass 78—teaches a tennis ball projecting machine for ejecting tennis balls in regular sequence and at a controlled velocity to simulate tennis service or return from an opponent during learning or practice sessions. The apparatus is directed to variation of the vertical and horizontal angles of ball ejection thereby providing game-like situations. The apparatus has two motor driven wheels mounted on the lower end of a vertical post member. To the upper end of the post member is attached members to rotate the motor mount and to elevate the wheels to vary the vertical trajectory of an object being projected.

(4) U.S. Pat. No. 4,383,695 to Ray.

U.S. Pat. No. 4,383,695—issued to Ray on May 17, 1983 in U.S. class 280 and subclass 47.26—teaches a ball picker dolly for retrieving tennis balls or the like, which includes a carriage having a shaft, a horizontal axle orthogonally attached to the lower end of the shaft, and apparatus mounted on the axle for votively supporting the carriage on a horizontal surface. Baskets or hoppers of varying configurations and sizes can be secured to the dolly by utilizing adjustable brackets. The various hoppers have griddled bottoms including a plurality of filiform members spaced-apart to define slot openings dimensioned to admit tennis balls forcibly pushed therethrough. At least one elongated horizontal bracket has spatially disposed pairs of openings thereon, and is slidably engageable on the shaft. Ancillary securing apparatus includes U-shaped prongs dimensioned to pass through spatially disposed openings in the bracket, mating with pairs of openings in either a horizontal or a vertical axis of the bracket. Yet another slidably engageable bracket is provided at the lower end of the shaft, which helps support the basket, and stabilizes the lower part of a basket to the shaft. Both brackets are tightened down by threaded bolts that pass through the brackets to impinge upon the shaft.

(5) U.S. Pat. No. 4,735,544 to Stotts.

U.S. Pat. No. 4,735,544—issued to Stotts on Apr. 5, 1988 in U.S. class 414 and subclass 440—teaches a portable ball retriever, holder, and carrier apparatus operable to pick-up and retrieve ball members from a support surface, hold the ball members in a container member in an elevated condition, and be folded into a compact condition for transport and/or storage. The portable ball retriever, holder, and carrier apparatus includes a main support frame assembly; a support and power drive assembly operable to provide mechanical power drive for a ball member retrieving function, a ball pick-up assembly having a rotatable cylinder member to pick-up the ball members and carry same upwardly and laterally, a ball container assembly mounted on the main support frame assembly to twelve ball members therein, and an actuator handle assembly that is movable to various positions. The ball pick-up assembly includes a main retriever housing having a rotatable pick-up cylinder assembly therein. The pick-up cylinder assembly includes a deformable cylinder member operable to receive ball members thereagainst, and being deformed to grasp the ball members for subsequent movement upwardly and laterally. The ball container assembly includes a container member that is movable from a horizontal position to receive ball members therein to an elevated holder condition position to hold the ball members for usage. The actuator handle assembly is provided with a collapsible actuator handle member for use in an extended rigid position for pushing the entire carrier apparatus, and foldable into a compact position over the ball container assembly for storage and transport purposes.

(6) U.S. Pat. No. 5,056,786 to Bellettini et al.

U.S. Pat. No. 5,056,786—issued to Bellettini et al. on Oct. 15, 1991 in U.S. class 473 and subclass 474—teaches a ball retriever using hook and mesh components in engaging relationship to one another; application of the two components in any fashion to retrieve a tennis ball. One being a racket with a section of hook material attached at the butt of the handle. Secondly, fitting a covering of intermeshing material around a tennis ball. When the butt of the racket is put in contact with a tennis ball having the mesh covering, the ball will fasten temporarily to the racket.

(7) U.S. Pat. No. 5,147,100 to Frankel.

U.S. Pat. No. 5,147,100—issued to Frankel on Sep. 15, 1992 in U.S. class 294 and subclass 19.2—teaches a ball retrieval device including a main body, and a ball collection basket for storing retrieved balls. The basket is shaped substantially as a slotted box. Only a single basket opening, located in a forward peripheral portion of the basket, has a width greater than the diameter of a ball. The collection basket is removably attached to the main body using a pair of upward-turned hooked bracket portions that extend through mesh openings in the basket and allow the basket to remain substantially horizontal when the basket is attached to or removed from the main body. Arms that extend from the main body are provided with an arrangement of resilient fingers, strips, brushes, or lips that form a channel in which balls are held when they are adjacent to the arms. These fingers, etc. channel balls along the arms towards a conveyor mechanism located within the main body as the ball retriever is pushed forward.

(8) U.S. Pat. No. 5,301,991 to Chen et al.

U.S. Pat. No. 5,301,991—issued to Chen et al. on Apr. 12, 1994 in U.S. class 294 and subclass 19.2—teaches a ball retrieving and storage cart generally including a wheeled carriage that rollingly supports a basket in a ball retrieving position. In an exemplary embodiment, the basket has a front end and a rear end and includes a bottom wall having two side members oriented front to rear and having a normal position spaced-apart less than the ball diameter and defining a slotted aperture for entrance of a ball into the basket. In the ball retrieval position, at least one of the side members is a slanted member having a front end higher from the ground than a ball radius and a rear end lower to the ground than the ball radius. At least one of the side members is a deflectable member, and is biased to the normal position but is sideways deflectable so that a ball on the ground entering the aperture sideways deflects the deflectable member sufficiently for the ball to pass into the basket. The wheels may define a rolling plane. The carriage includes a vertical frame member terminating in a push handle, and the vertical frame member includes brackets for attaching a moveable basket at a serving position higher that is than the ball retrieving position.

(9) U.S. Pat. No. 6,340,188 to Cuti.

U.S. Pat. No. 6,340,188—issued to Cuti on Jan. 22, 2002 in U.S. class 294 and subclass 19.2—teaches a tennis ball retriever and multi-purpose tennis ball hopper and caddy that holds all of the tennis equipment used during play and practice. The retriever utilizes a hopper portion incorporating a pair of opening spaces with a plurality of fingers formed therein for permitting tennis balls to pass into the hopper. The retriever includes a small storage unit for valuables and for new and practice tennis balls. The carrying handle is retractable thereby taking up less space than conventional tennis hoppers.

(10) United States Patent Application Publication Number 2006/0082171 to Olmstead.

United States Patent Application Publication Number 2006/0082171—published to Olmstead on Apr. 20, 2006 in U.S. class 294 and subclass 19.2—teaches a ball pickup hopper on supporting wheels, which has a bottom panel contoured with channels extending from a front of the hopper to the supporting wheels. Extending forward of the hopper are opposing left and a right herding rails directing balls in front of the apparatus into the channels as the apparatus is moved over a ground surface. The supporting wheels are positioned and adapted for receiving balls moving through the channels, compressively rotating and lifting the balls between the supporting wheels and the hopper, and expelling the balls into the hopper through openings. A top cover is fitted to enclose the hopper, and to alternately, act as a base for supporting the hopper at an appropriate height for use in ball practice.

(11) United States Patent Application Publication Number 2011/0262259 to Zats.

United States Patent Application Publication Number 2011/0262259—published to Zats on Oct. 27, 2011 in U.S. class 414 and subclass 800—teaches an increased capacity portable retriever for collecting and dispensing tennis balls utilized on a flat surface, which includes a horizontally elongated container having a front retrieving section with a top handle, a rear collecting section pivotably supported by two wheels coaxially mounted at a bottom wall, and a front wall dispensing opening with a cover. The front retrieving section contains bottom parallel rods spaced from each other a distance smaller than the tennis ball diameter. The container has horizontal retrieving and vertical dispensing positions. The container includes a compartment capacity regulating element for dispensing balls individually. First method of retrieving, collecting, and dispensing tennis balls includes repetitive transferring a substantial group of balls from the retrieving section towards the collecting section. Second method includes cyclical reducing the container compartment capacity correspondingly to a volume of balls group resided in the compartment after dispensing a comfortably reachable balls portion from the container.

It is apparent that numerous innovations for tennis ball throwers and retrievers have been provided in the prior art, which are adapted to be used. Furthermore, even though these innovations may be suitable for the specific individual purposes to which they address, nevertheless, they would not be suitable for the purposes of the embodiments of the present invention as heretofore described.

2. SUMMARY OF THE INVENTION

Thus, an object of the embodiments of the present invention is to provide a cart for collecting tennis balls on the ground when manually pushed by a user and for storing the tennis balls once collected, which avoids the disadvantages of the prior art.

Briefly stated, another object of the embodiments of the present invention is to provide a cart that collects tennis balls on the ground when manually pushed by a user and stores the tennis balls once collected. The cart includes a housing, a gathering assembly, a conveyor assembly, and a receptacle. The housing is manually pushed by the user. The gathering assembly is operatively connected to the housing, and gathers the tennis balls on the ground. The conveyor assembly is operatively connected within the housing. The receptacle is disposed against the housing, and stores the tennis balls elevated thereto by the conveyor assembly, which have been gathered by the gathering assembly.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

Figure 1:
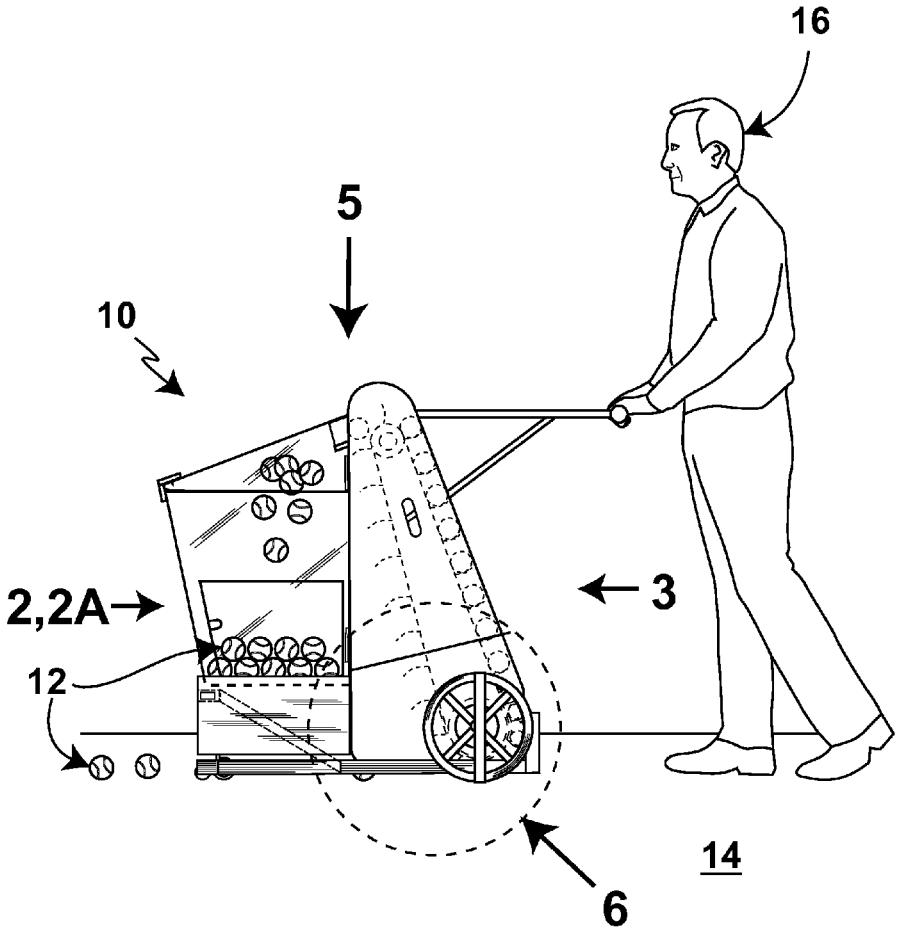
FIG. 1 is a diagrammatic side elevational view of the cart of the embodiments of the present invention collecting tennis balls on the ground when manually pushed by a user and storing the tennis balls once collected.

A. Introductory.

| | |
|---|---|
| 10 | cart of embodiments of present invention for collecting tennis balls 12 on ground 14 when manually pushed by user 16 and for storing tennis balls 12 once collected |
| 12 | tennis balls |
| 14 | ground |
| 16 | user |

B. Overall Configuration of Cart 10.

| | |
|---|---|
| 18 | housing for being manually pushed by user 16 |
| 20 | gathering assembly for gathering tennis balls 12 on ground 14 |
| 22 | conveyor assembly |
| 24 | receptacle for storing tennis balls 12 elevated thereto by conveyor assembly 22, which have been gathered by gathering assembly 20 |

C. Specific Configuration of Housing 18.

| | |
|---|---|
| 26 | base frame of housing 18 for being in proximity to ground 14 |
| 28 | front edge of base frame 26 of housing 18 |
| 30 | rear edge of base frame 26 of housing 18 |
| 32 | pair of side edges of base frame 26 of housing 18 |
| 34 | back panel of housing 18 |
| 36 | terminal edge of back panel 34 of housing 18 |
| 38 | top panel of housing 18 |
| 40 | terminal edge of top panel 38 of housing 18 |

-continued

| | |
|---|---|
| 42 | front panel of housing 18 |
| 44 | through slot of front panel 42 of housing 18 |
| 46 | open-topped chute of front panel 42 of housing 18 for directing tennis balls 12 passing through through slot 44 of front panel 42 of housing 18 into receptacle 24 |
| 48 | pair of side panels of housing 18 |
| 49 | portion of each side panel of pair of side panels 48 of housing 18 |
| 50 | recess of portion 49 of each side panel of pair of side panels 48 of housing 18 for facilitating grabbing and opening of portion 49 of associated side panel of pair of side panels 48 of housing 18 |
| 52 | steering handlebar of housing 18 for steering cart 10 by user 16 |
| 54 | pair of support bars of housing 18 |

D. Specific Configuration of Gathering Assembly 20.

| | |
|---|---|
| 56 | pair of arms of gathering assembly 20 for gathering tennis balls 12 on ground 14 when pair of arms 56 of gathering assembly 20 are in in-use position thereof and cart 10 is pushed forwardly by user 16 |
| 58 | proximal portion of each arm of pair of arms 56 of gathering assembly 20 |
| 60 | distal portion of each arm of pair of arms 56 of gathering assembly 20 |
| 62 | pair of shafts of gathering assembly 20 |
| 63 | proximal ends of pair of shafts 62 of gathering assembly 20, respectively |
| 64 | terminal distal ends of pair of shafts 62 of gathering assembly 20, respectively |
| 66 | pair of pedals of gathering assembly 20 |
| 68 | pair of wheels of gathering assembly 20 for rolling on ground 14 when pair of arms 56 of gathering assembly 20 are in in-use position thereof |
| 70 | pair of magnets of gathering assembly 20 |

E. Specific Configuration of Conveyor Assembly 22.

| | |
|---|---|
| 72 | upper axle of conveyor assembly 22 |
| 73 | lower axle of conveyor assembly 22 |
| 74 | pair of rear wheels of conveyor assembly 22 for rolling on ground 14 when user 16 pushes cart 10 |
| 76 | conveyor belt of conveyor assembly 22 |
| 77 | plurality of scooping shelves of conveyor belt 76 of conveyor system 22 for lifting tennis balls 12 from gathering assembly 20 up and into receptacle 24 |
| 78 | pair of ends of lower axle 73 of conveyor assembly 22 |
| 80 | pair of double ratchet assemblies 80 of conveyor assembly 22 |
| 82 | ratchet ring of each double ratchet assembly of pair of double ratchet assemblies 80 of conveyor assembly 22 |
| 84 | interior peripheral teeth of ratchet ring 82 of each double ratchet assembly of pair of double ratchet assemblies 80 of conveyor assembly 22 |
| 86 | exterior peripheral teeth of ratchet ring 82 of each double ratchet assembly of pair of double ratchet assemblies 80 of conveyor assembly 22 |
| 88 | interior pawl of each double ratchet assembly of pair of double ratchet assemblies 80 of conveyor assembly 22 |
| 90 | exterior pawl of each double ratchet assembly of pair of double ratchet assemblies 80 of conveyor assembly 22 |

F. Specific Configuration of Receptacle 24.

| | |
|---|---|
| 92 | lower portion of receptacle 24 |
| 94 | upper portion of receptacle 24 |
| 96 | lid of receptacle 24 for directing tennis balls 12 from through slot 44 of front panel 42 of housing 18 into upper portion 94 of receptacle 24 |
| 98 | open top of lower portion 92 of receptacle 24 |
| 100 | open bottom of upper portion 94 of receptacle 24 |
| 102 | open top of upper portion 94 of receptacle 24 |
| 104 | hinges of receptacle 24 |

-continued

| | |
|---|---|
| 106 | pair of front wheels of receptacle 24 for rolling on ground 14 when cart 10 is pushed by user 16 |
| 108 | pin part of each hinge of hinges 104 of receptacle 24 |
| 110 | non-pin part of each hinge of hinges 104 of receptacle 24 |

5. DETAILED DESCRIPTION OF THE PREFERRED EMBODIMENTS

A. Introductory.

Referring now to the figures, in which like numerals indicate like parts, and particularly to FIG. 1, which is a diagrammatic side elevational view of the cart of the embodiments of the present invention collecting tennis balls on the ground when manually pushed by a user and storing the tennis balls once collected, the cart of the embodiments of the present invention is shown generally at 10 for collecting tennis balls 12 on the ground 14 when manually pushed by a user 16 and for storing the tennis balls 12 once collected.

B. Overall Configuration of the Cart 10.

Figure 2:
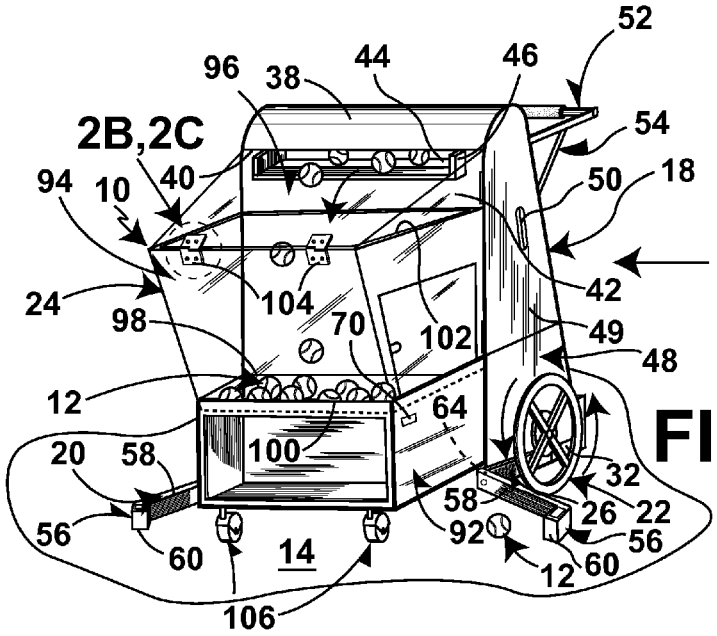
FIG. 2 is a diagrammatic perspective view taken generally in the direction of ARROW 2 in FIG. 1 of the cart of the embodiments of the present invention with the receptacle thereof closed.
Figure 2A:
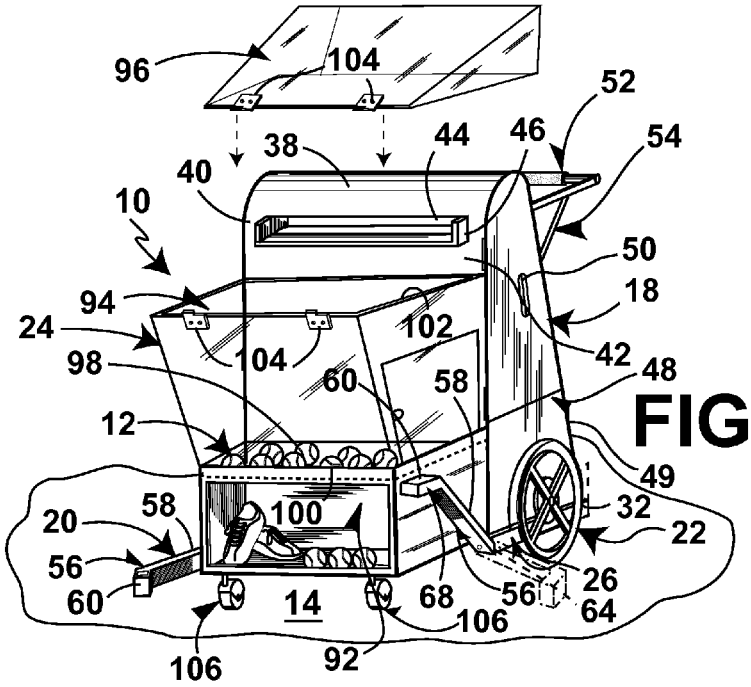
FIG. 2A is an exploded diagrammatic perspective view taken generally in the direction of ARROW 2A in FIG. 1 of the cart of the embodiments of the present invention with the receptacle thereof open.

The overall configuration of the cart 10 can best be seen in FIGS. 2, 2A, 3, 4, and 5, which are, respectively, a diagrammatic perspective view taken generally in the direction of ARROW 2 in FIG. 1 of the cart of the embodiments of the present invention with the receptacle thereof closed, an exploded diagrammatic perspective view taken generally in the direction of ARROW 2A in FIG. 1 of the cart of the embodiments of the present invention with the receptacle thereof open, an enlarged rear end view taken generally in the direction of ARROW 3 in FIG. 1 of the cart of the embodiments of the present invention, an enlarged diagrammatic side elevational view taken generally in the direction of ARROW 4 in FIG. 2 of the cart of the embodiments of the present invention, and an enlarged diagrammatic top plan view taken generally in the direction of ARROW 5 in FIG. 1 of the cart of the embodiments of the present invention, and as such, will be discussed with reference thereto.

The cart 10 comprises a housing 18, a gathering assembly 20, a conveyor assembly 22, and a receptacle 24. The housing 18 is for being manually pushed by the user 16. The gathering assembly 20 is operatively connected to the housing 18, and is for gathering the tennis balls 12 on the ground 14. The conveyor assembly 22 is operatively connected within the housing 18. The receptacle 24 is disposed against the housing 18, and is for storing the tennis balls 12 elevated thereto by the conveyor assembly 22, which have been gathered by the gathering assembly 20.

C. Specific Configuration of the Housing 18.

The specific configuration of the housing 18 can best be seen again in FIGS. 2, 2A, 3, 4, and 5, which are, respectively, a diagrammatic perspective view taken generally in the direction of ARROW 2 in FIG. 1 of the cart of the embodiments of the present invention with the receptacle thereof closed, an exploded diagrammatic perspective view taken generally in the direction of ARROW 2A in FIG. 1 of the cart of the embodiments of the present invention with the receptacle thereof open, an enlarged rear end view taken generally in the direction of ARROW 3 in FIG. 1 of the cart of the embodiments of the present invention, an enlarged diagrammatic side elevational view taken generally in the direction of ARROW 4 in FIG. 2 of the cart of the embodiments of the present invention, and an enlarged diagrammatic top plan view taken generally in the direction of ARROW 5 in FIG. 1 of the cart of the embodiments of the present invention, and as such, will be discussed with reference thereto.

The housing 18 comprises a base frame 26.

The base frame 26 of the housing 18 is horizontally oriented, generally square-shaped, is for being in proximity to the ground 14, and has a front edge 28, a rear edge 30, and a pair of side edges 32.

The housing 18 further comprises a back panel 34.

The back panel 34 of the housing 18 extends obliquely upwardly and forwardly from the base frame 26 of the housing 18 to a terminal edge 36.

The housing 18 further comprises a top panel 38.

The top panel 38 of the housing 18 is inverted U-shaped so as to be convexo-concave-shaped, and extends forwardly from the terminal edge 36 of the back panel 28 of the housing 18 to a terminal edge 40.

The housing 18 further comprises a front panel 42.

The front panel 42 of the housing 18 extends obliquely downwardly and forwardly from the terminal edge 40 of the top panel 38 of the housing 18 to the front edge 28 of the base frame 26 of the housing 18.

The front panel 42 of the housing 18 has a through slot 44.

The through slot 44 of the front panel 42 of the housing 18 is generally rectangular-shaped, is horizontally oriented, and extends downwardly from the terminal edge 40 of the top panel 38 of the housing 18.

The front panel 42 of the housing 18 further has an open-topped chute 46.

The open-topped chute 46 of the front panel 42 of the housing 18 extends forwardly from around the through slot 44 of the front panel 42 of the housing 18 towards the receptacle 24 for directing the tennis balls 12 passing through the through slot 44 of the front panel 42 of the housing 18 down into the receptacle 24.

The housing 18 further comprises a pair of side panels 48.

The pair of side panels 48 of the housing 18 extend forwardly from the back panel 34 of the housing 18 to the front panel 42 of the housing 18, and upwardly from the pair of side edges 32 of the base frame 26 of the housing 18, respectively, to the top panel 38 of the housing 18.

A portion 49 of each side panel 48 of the housing 18 is hinged to the front panel 42 of the housing 18 so as to allow access to a portion of the conveyor assembly 22 that is contained within the housing 18.

The portion 49 of each side panel 48 of the housing 18 contains a recess 50. The recess 50 of the portion 49 of each side panel 48 of the housing 18 is for facilitating grabbing and opening of the portion 49 of an associated side panel 48 of the housing 18.

The housing 18 further comprises a steering handlebar 52.

The steering handlebar 52 of the housing 18 is generally U-shaped, horizontally oriented, extends rearwardly from the terminal edge 36 of the back panel 28 of the housing 18, and is for steering the cart 10 by the user 16.

The housing 18 further comprises a pair of support bars 54.

The pair of support bass 54 of the housing 18 are parallel to each other, spaced-apart form each other, and extend obliquely downwardly and forwardly from the steering handlebar 52 of the housing 18 to the back panel 34 of the housing 18 so as to form braces of the steering handlebar 52 of the housing 18.

D. Specific Configuration of the Gathering Assembly 20.

Figure 3:
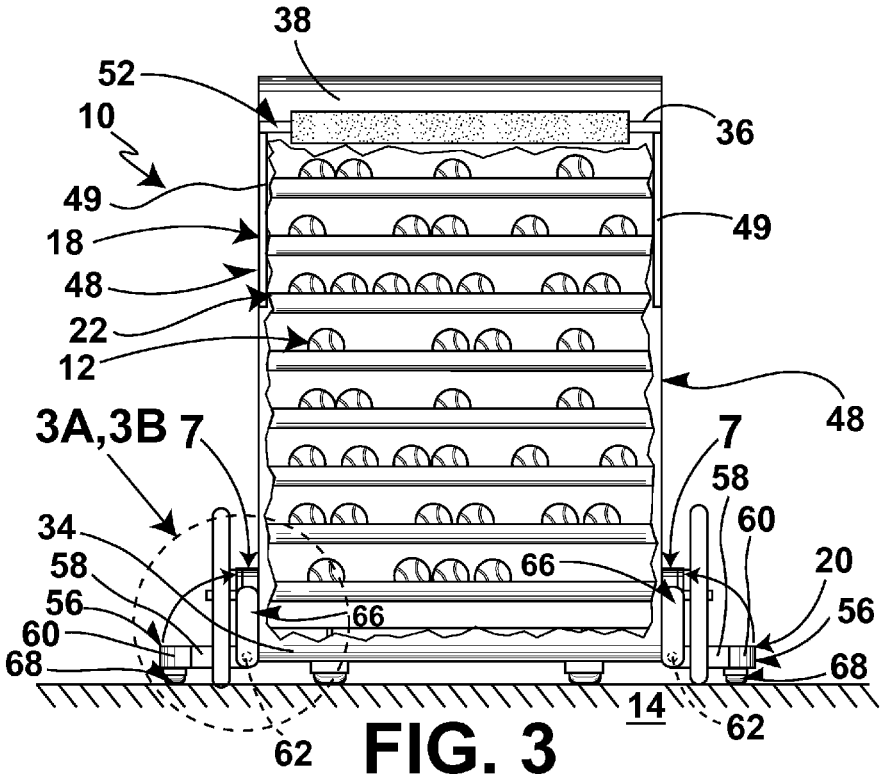
FIG. 3 is an enlarged rear end view taken generally in the direction of ARROW 3 in FIG. 1 of the cart of the embodiments of the present invention.
Figure 3A:
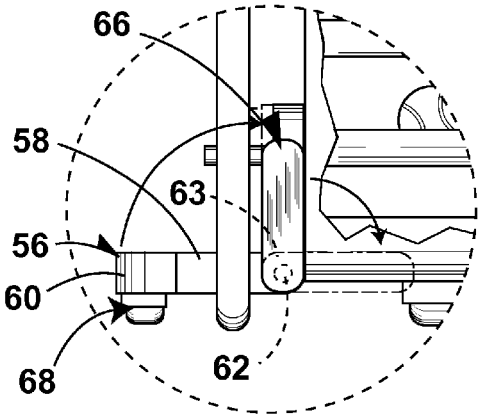
FIG. 3A is an enlarged diagrammatic rear end view of the area generally enclosed by the dotted circle identified by ARROW 3A in FIG. 3 of the gathering assembly of the cart of the embodiments of the present invention in the operational mode thereof.
Figure 3B:
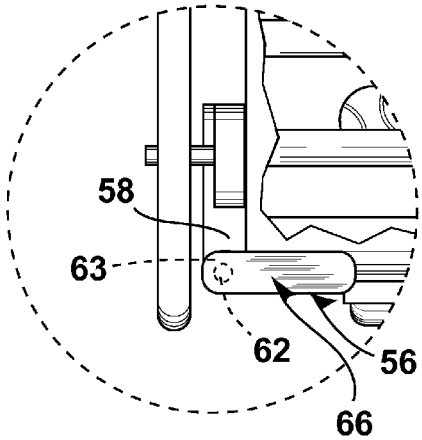
FIG. 3B is an enlarged diagrammatic rear end view of the area generally enclosed by the dotted circle identified by ARROW 3B in FIG. 3 of the gathering assembly of the cart of the embodiments of the present invention in the non-operational mode.
Figure 5:
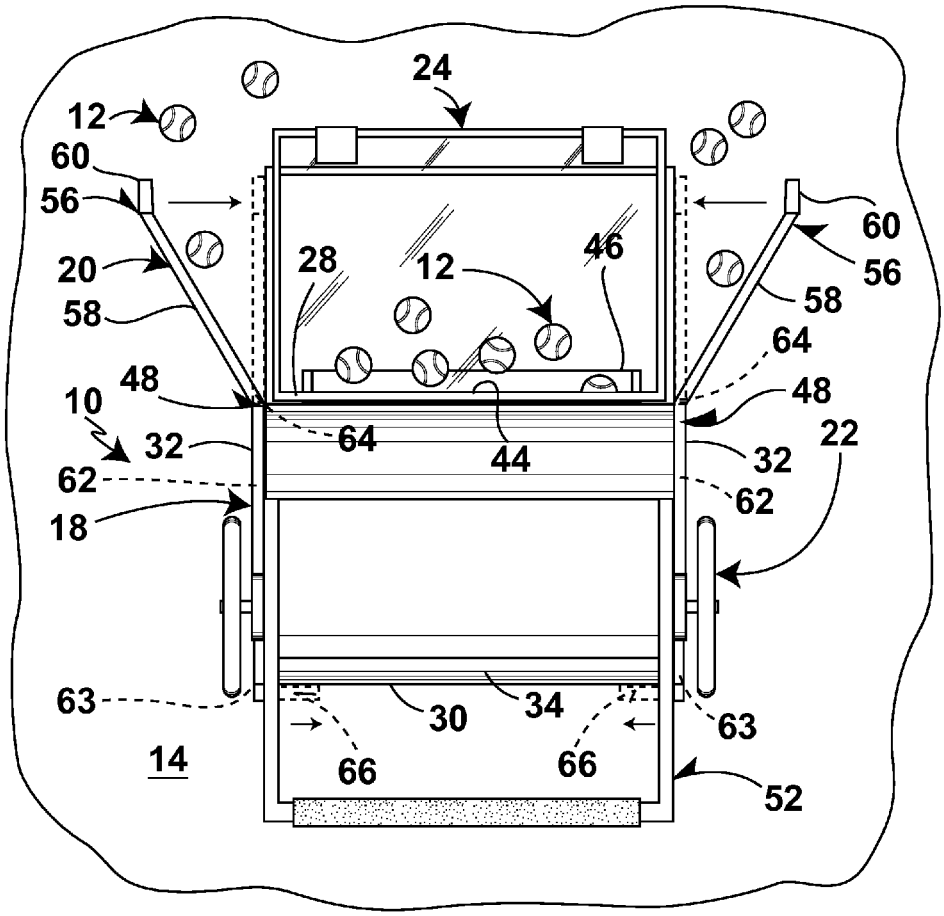
FIG. 5 is an enlarged diagrammatic top plan view taken generally in the direction of ARROW 5 in FIG. 1 of the cart of the embodiments of the present invention.
Figure 6:
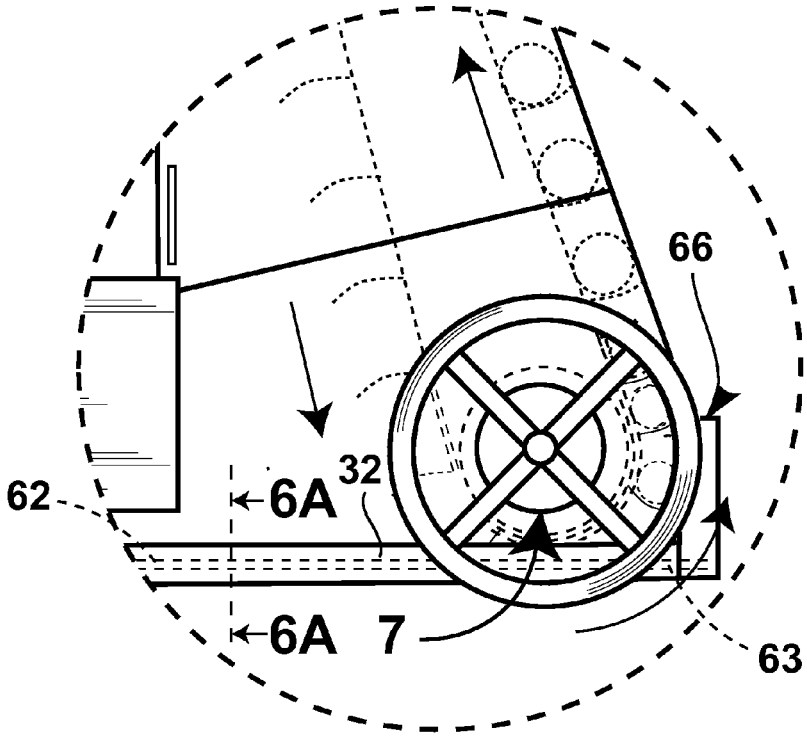
FIG. 6 is an enlarged diagrammatic side elevational view of the area generally enclosed by the dotted circle identified by ARROW 6 in FIG. 1 of a portion of the gathering assembly and a portion of the conveyor assembly of the cart of the embodiments of the present invention.
Figure 6A:
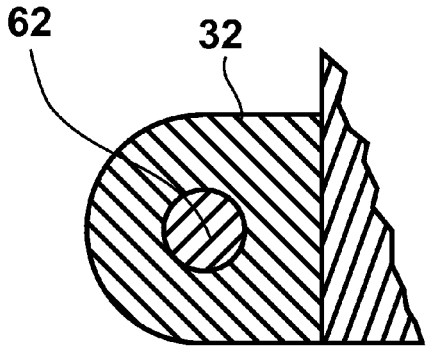
FIG. 6A is an enlarged diagrammatic cross sectional view taken along LINE 6A-6A in FIG. 6 of a portion of the gathering assembly of the cart of the embodiments of the present invention.

The specific configuration of the gathering assembly 20 can best be seen in FIGS. 2, 2A, 3, 3A, 3B, 4, 5, 6, and 6A, which are, respectively, again a diagrammatic perspective view taken generally in the direction of ARROW 2 in FIG. 1 of the cart of the embodiments of the present invention with the receptacle thereof closed, again an exploded diagrammatic perspective view taken generally in the direction of ARROW 2A in FIG. 1 of the cart of the embodiments of the present invention with the receptacle thereof open, again an enlarged rear end view taken generally in the direction of ARROW 3 in FIG. 1 of the cart of the embodiments of the present invention, an enlarged diagrammatic rear end view of the area generally enclosed by the dotted circle identified by ARROW 3A in FIG. 3 of the gathering assembly of the cart of the embodiments of the present invention in the operational mode thereof, an enlarged diagrammatic rear end view of the area generally enclosed by the dotted circle identified by ARROW 3B in FIG. 3 of the gathering assembly of the cart of the embodiments of the present invention in the non-operational mode, again an enlarged diagrammatic side elevational view taken generally in the direction of ARROW 4 in FIG. 2 of the cart of the embodiments of the present invention, again an enlarged diagrammatic top plan view taken generally in the direction of ARROW 5 in FIG. 1 of the cart of the embodiments of the present invention, an enlarged diagrammatic side elevational view of the area generally enclosed by the dotted circle identified by ARROW 6 in FIG. 1 of a portion of the gathering assembly and a portion of the conveyor assembly of the cart of the embodiments of the present invention, and an enlarged diagrammatic cross sectional view taken along LINE 6A-6A in FIG. 6 of a portion of the gathering assembly of the cart of the embodiments of the present invention, and as such, will be discussed with reference thereto.

The gathering assembly 20 comprises a pair of anus 56.

The pair of arms 56 of the gathering assembly 20 are pivotally attached to the pair of side edges 32 of the base frame 26 of the housing 18, respectively, so as to have in-use positions and stored positions.

The pair of arms 56 of the gathering assembly 20 extend forwardly and outwardly on the ground 14 for gathering the tennis balls 12 on the ground 14 when the pair of arms 56 of the gathering assembly 20 are in the in-use position thereof and the cart 10 is pushed forwardly by the user 16.

The pair of arms 56 of the gathering assembly 20 extend upwardly against the receptacle 24, out of the way when the pair of arms 56 of the gathering assembly 20 are in the stored positions thereof.

Each arm 56 of the gathering assembly 20 has a proximal portion 58 and a distal portion 60.

The proximal portion 58 of each arm 56 of the gathering assembly 20 extends pivotally and obliquely from an associated side edge 32 of the base frame 26 of the housing 18.

The distal portion 60 of each arm 56 of the gathering assembly 20 extends forwardly from the proximal portion 58 of an associated arm 56 of the gathering assembly 20.

The gathering assembly 20 further comprises a pair of shafts 62.

The pair of shafts 62 of the gathering assembly 20 pass rotatably through the pair of side edges 32 of the base frame 26 of the housing 18, respectively, from proximal ends 63 thereof to terminal distal ends 64 thereof, respectively.

The gathering assembly 20 further comprises a pair of pedals 66.

The pair of pedals 66 of the gathering assembly 20 are affixed to the proximal ends 63 of the pair of shafts 62 of the gathering assembly 20, respectively, and are positioned upwardly when the pair of arms 56 of the gathering assembly 20 are in the in-use positions thereof, and when stepped down upon by the user 16, become positioned sidewardly so as to be in the stored positions thereof.

The proximal portion 58 of each arm 56 of the gathering assembly 20 are fixedly attached to the terminal distal ends 64 of the pair of shafts 62 of the gathering assembly 20, respectively, and rotate therewith.

The gathering assembly 20 further comprises a pair of wheels 68.

The pair of wheels 68 of the gathering assembly 20 depend rotatably from the distal portion 60 of each arm 56 of the gathering assembly 20, respectively, and are for rolling on the ground 14 when the pair of arms 56 of the gathering assembly 20 are in the in-use positions thereof.

The gathering assembly 20 further comprises a pair of magnets 70.

The pair of magnets 70 of the gathering assembly 20 are disposed on the receptacle 24, and hold the pair of aims 56 of the gathering assembly 20 up when the pair of arms 56 of the gathering assembly 20 are in the stored positions thereof.

E. Specific Configuration of the Conveyor Assembly 22.

Figure 4:
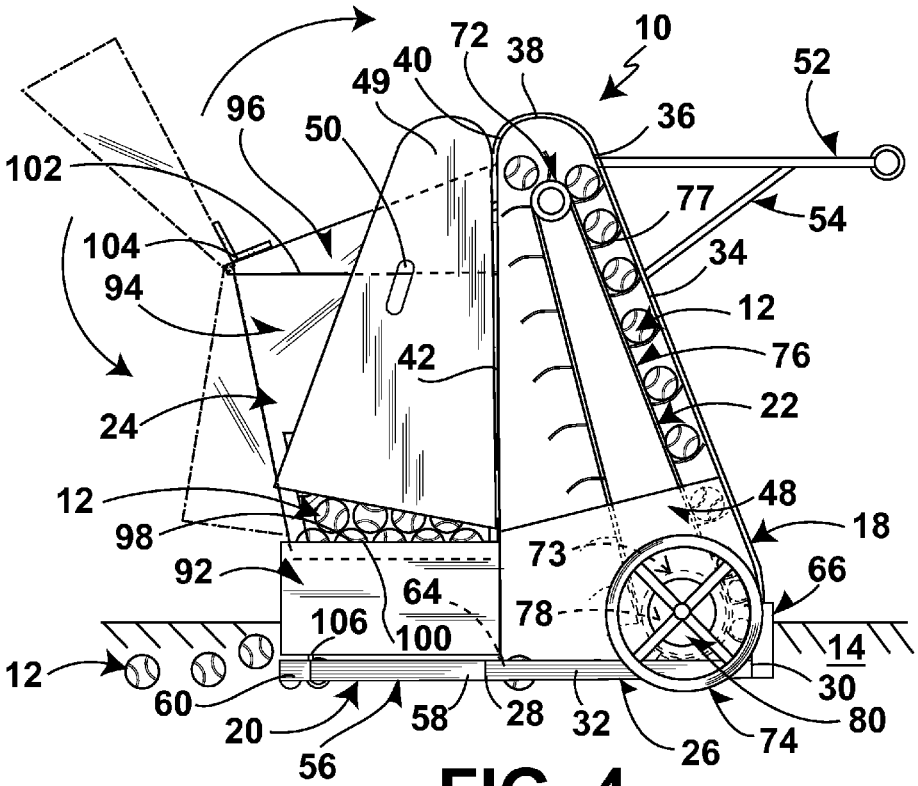
FIG. 4 is an enlarged diagrammatic side elevational view taken generally in the direction of ARROW 4 in FIG. 2 of the cart of the embodiments of the present invention.
Figure 2B:
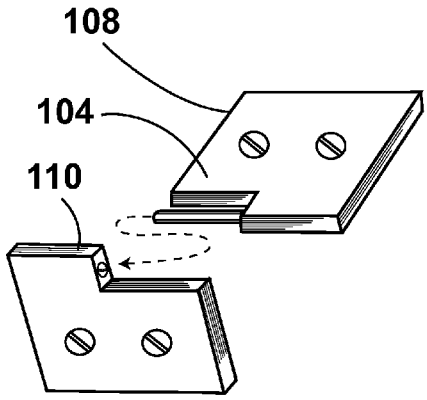
FIG. 2B is an enlarged and exploded diagrammatic perspective view of the area generally enclosed by the dotted circle identified by ARROW 2B in FIG. 2 of a hinge of the receptacle of the cart of the embodiments of the present invention.
Figure 2C:
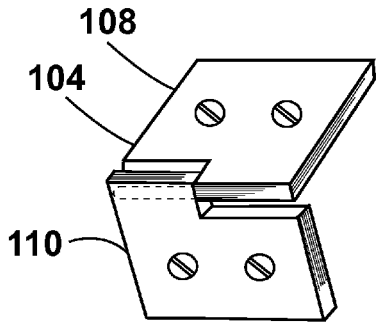
FIG. 2C is an enlarged and exploded diagrammatic perspective view of the area generally enclosed by the dotted circle identified by ARROW 2C in FIG. 2 of a hinge of the receptacle of the cart of the embodiments of the present invention.
Figure 7:
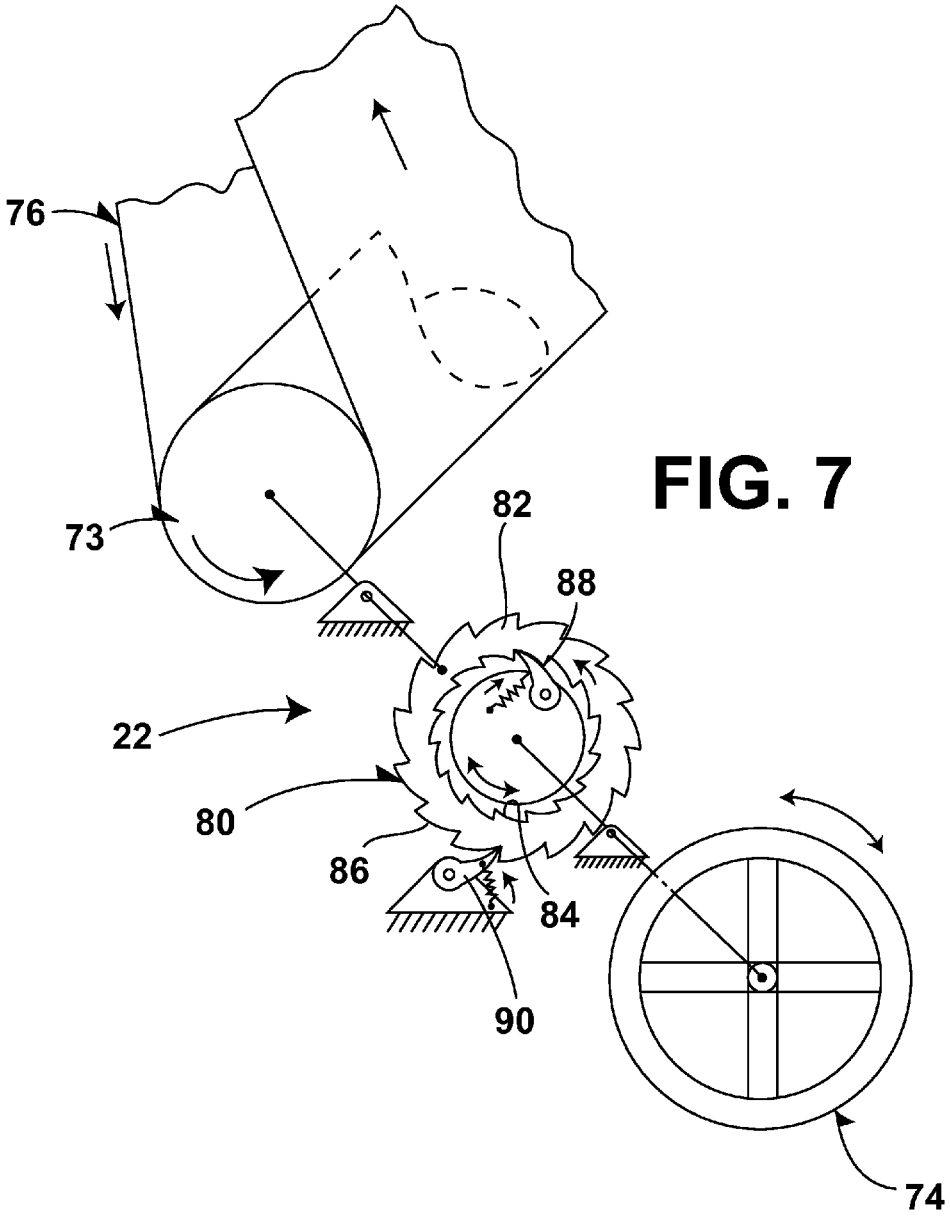
FIG. 7 is a diagrammatic view of a portion of the conveyor assembly of the cart of the embodiments of the present invention identified by ARROW 7 in FIG. 6.

The specific configuration of the conveyor assembly 22 can best be seen in FIGS. 4 and 7, which are, respectively, again, an enlarged diagrammatic side elevational view taken generally in the direction of ARROW 4 in FIG. 2 of the cart of the embodiments of the present invention, and a diagrammatic view of a portion of the conveyor assembly of the cart of the embodiments of the present invention identified by ARROW 7 in FIG. 6, and as such, will be discussed with reference thereto.

The conveyor assembly 22 comprises an upper axle 72.

The upper axle 72 of the conveyor assembly 22 is horizontally oriented, and contained rotatably within the housing 18, just below the top panel 38 of the housing 18.

The conveyor assembly 22 further comprises a lower axle 73.

The lower axle 73 of the conveyor assembly 22 is horizontally oriented, is contained rotatably within the housing 18, just above the base frame 26 of the housing 18 and below and behind the upper axle 72 of the conveyor assembly 22.

The conveyor assembly 22 further comprises a pair of rear wheels 74.

The pair of rear wheels 74 of the conveyor assembly 22 are operatively connected to the lower axle 73 of the conveyor assembly 22, rotate independently of each other so as to function as a differential and allow the cart 10 to turn, and are for rolling on the ground 14 when the user 16 pushes the cart 10.

The conveyor assembly 22 further comprises a conveyor belt 76.

The conveyor belt 76 of the conveyor assembly 22 is endless, and reeves around both the upper axle 72 of the conveyor assembly 22 and the lower axle 73 of the conveyor assembly 22.

The conveyor belt 76 of the conveyor system 22 has a plurality of scooping shelves 77.

The plurality of scooping shelves 77 of the conveyor belt 76 of the conveyor system 22 are horizontally oriented, are spaced-apart from each other along the conveyor belt 76 of the conveyor system 22, and are for scooping and lifting the tennis balls 12 from the gathering assembly 20 up and into the receptacle 24.

The lower axle 73 of the conveyor assembly 22 has a pair of ends 78, and the conveyor assembly 22 further comprises a pair of double ratchet assemblies 80.

The pair of double ratchet assembly 80 of the conveyor assembly 22 are not operatively connected to each other so as to work independently of each other.

Each double ratchet assembly 80 of the conveyor assembly 22 is operatively connected to and between an associated end 78 of the lower axle 73 of the conveyor assembly 22 and an associated rear wheel 74 of the conveyor assembly 22.

Each double ratchet assembly 80 of the conveyor assembly 22 comprises a ratchet ring 82.

The ratchet ring 82 of each double ratchet assembly 80 of the conveyor assembly 22 has interior peripheral teeth 84 and exterior peripheral teeth 86.

The interior peripheral teeth 84 of the ratchet ring 82 of each double ratchet assembly 80 of the conveyor assembly 22 face oppositely to the exterior peripheral teeth 86 of the ratchet ring 82 of an associated double ratchet assembly 80 of the conveyor assembly 22.

Each double ratchet assembly 80 of the conveyor assembly 22 further comprises an interior pawl 88 and an exterior pawl 90.

The interior pawl 88 of each double ratchet assembly 80 of the conveyor assembly 22 interacts with the interior peripheral teeth 84 of the ratchet ring 82 of an associated double ratchet assembly 80 of the conveyor assembly 22, and in so doing, connects an associated rear wheel 74 of the conveyor assembly 22 to the lower axle 73 of the conveyor assembly 22 so as to allow the conveyor assembly 22 to operate when either rear wheel 74 of the conveyor assembly 22 rotates by virtue of being rolled on the ground 14 when pushed by the user 16.

The exterior pawl 90 of each double ratchet assembly 80 of the conveyor assembly 22 interacts with the exterior teeth 86 of the ratchet ring 82 of an associated double ratchet assembly 80 of the conveyor assembly 22, and in so doing, prevents the lower axle 73 of the conveyor assembly 22 from rotating backwards.

F. Specific Configuration of the Receptacle 24.

The specific configuration of the receptacle 24 can best be seen in FIGS. 2, 2A, 2B, 2C, and 4, which are respectively, again, a diagrammatic perspective view taken generally in the direction of ARROW 2 in FIG. 1 of the cart of the embodiments of the present invention with the receptacle thereof closed, again, an exploded diagrammatic perspective view taken generally in the direction of ARROW 2A in FIG. 1 of the cart of the embodiments of the present invention with the receptacle thereof open, an enlarged and exploded diagrammatic perspective view of the area generally enclosed by the dotted circle identified by ARROW 2B in FIG. 2 of a hinge of the receptacle of the cart of the embodiments of the present invention, an enlarged and exploded diagrammatic perspective view of the area generally enclosed by the dotted circle identified by ARROW 2C in FIG. 2 of a hinge of the receptacle of the cart of the embodiments of the present invention, and, again, an enlarged diagrammatic side elevational view taken generally in the direction of ARROW 4 in FIG. 2 of the cart of the embodiments of the present invention, and as such, will be discussed with reference thereto.

The receptacle 24 comprises a lower portion 92, an upper portion 94, and a lid 96.

The lower portion 92 of the receptacle 24 is rectangular-parallelepiped-shaped, abuts against the front panel 42 of the housing 18, and has an open top 98.

The upper portion 94 of the receptacle 24 is trapezoidal-shaped, sits on top of the lower portion 92 of the receptacle 24, and has an open bottom 100 and an open top 102.

The open top 98 of the lower portion 92 of the receptacle 24 communicates with the open bottom 100 of the upper portion 94 of the receptacle 24.

The lid 96 of the receptacle 24 is wedge-shaped, is hingedly attached by hinges 104 to, and selectively closes, the open top 102 of the upper portion 94 of the receptacle 24.

The lid 96 of the receptacle 24 has a range of motion. The range of motion of the lid 96 of the receptacle 24 is from the open top 102 of the upper portion 94 of the receptacle 24 to against the upper portion 94 of the receptacle 24.

The lid 96 of the receptacle 24 communicates with the through slot 44 of the front panel 42 of the housing 18 for directing the tennis balls 12 from the through slot 44 of the front panel 42 of the housing 18 into the upper portion 94 of the receptacle 24.

The receptacle 24 further comprises a pair of front wheels 106.

The pair of front wheels 106 of the receptacle 24 depend from the lower portion 92 of the receptacle 24, and are for rolling on the ground 14 when the cart 10 is pushed by the user 16.

Each hinge 104 of the receptacle 24 has a pin part 108 and a non-pin part 110.

The non-pin part 110 of each hinge 104 of the receptacle 24 are disposed along the upper portion 94 of the receptacle 24, while the pin part 108 of each hinge 104 of the receptacle 24 are disposed along the lid 96 of the receptacle 24 so as to allow the lid 96 of the receptacle 24 to be removed from the upper portion 94 of the receptacle 24 by merely sliding the lid 96 of the receptacle 24 sideways.

G. Impressions.

It will be understood that each of the elements described above or two or more together may also find a useful application in other types of constructions differing from the types described above.

While the embodiments of the present invention have been illustrated and described as embodied in a cart for collecting tennis balls on the ground when manually pushed by a user and for storing the tennis balls once collected, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A cart for collecting tennis balls on the ground when manually pushed by a user and for storing the tennis balls once collected, comprising:

a) a housing;

b) a gathering assembly;

c) a conveyor assembly; and d) a receptacle;

wherein said housing is for being manually pushed by the user;

wherein said gathering assembly is operatively connected to said housing;

wherein said gathering assembly is for gathering the tennis balls on the ground;

wherein said conveyor assembly is operatively connected within said housing;

wherein said receptacle is disposed against said housing;

wherein said receptacle is for storing the tennis balls elevated thereto by said conveyor assembly that have been gathered by said gathering assembly;

wherein said housing comprises a base frame;

wherein said base frame of said housing is horizontally oriented;

wherein said base frame of said housing is generally square-shaped;

wherein said base frame of said housing is for being in proximity to the ground;

wherein said base frame of said housing has:

a) a front edge;

b) a rear edge; and c) a pair of side edges;

wherein said housing comprises a back panel;

wherein said back panel of said housing extends obliquely upwardly and forwardly from said base frame of said housing to a terminal edge;

wherein said housing comprises a top panel;

wherein said top panel of said housing is inverted U-shaped so as to be convexo-concave-shaped;

wherein said top panel of said housing extends forwardly from said terminal edge of said back panel of said housing to a terminal edge;

wherein said housing comprises a front panel;

wherein said front panel of said housing extends obliquely downwardly and forwardly from said terminal edge of said top panel of said housing to said front edge of said base frame of said housing;

wherein said front panel of said housing has a through slot;

wherein said through slot of said front panel of said housing is generally rectangular-shaped;

wherein said through slot of said front panel of said housing is horizontally oriented;

wherein said through slot of said front panel of said housing extends downwardly from said terminal edge of said top panel of said housing;

wherein said front panel of said housing has an open-topped chute;

wherein said open-topped chute of said front panel of said housing extends forwardly from around said through slot of said front panel of said housing towards said receptacle for directing the tennis balls passing through said through slot of said front panel of said housing down into said receptacle;

wherein said housing comprises a pair of side panels;

wherein said pair of side panels of said housing extend forwardly from said back panel of said housing to said front panel of said housing and upwardly from said pair of side edges of said base frame of said housing, respectively, to said top panel of said housing;

wherein a portion of each side panel of said housing is hinged to said front panel of said housing so as to allow access to a portion of said conveyor assembly that is contained within said housing;

wherein said portion of each side panel of said housing contains a recess; and wherein said recess of said portion of each side panel of said housing is for facilitating grabbing and opening of said portion of an associated side panel of said housing;

wherein said housing comprises a steering handlebar;

wherein said steering handlebar of said housing is generally U-shaped;

wherein said steering handlebar of said housing is horizontally oriented;

wherein said steering handlebar of said housing extends rearwardly from said terminal edge of said back panel of said housing;

wherein said steering handlebar of said housing is for steering said cart by the user;

wherein said housing comprises a pair of support bars;

wherein said pair of support bars of said housing are parallel to each other; and wherein said pair of support bars of said housing are spaced-apart from each other;

wherein said pair of support bars of said housing extend obliquely downwardly and forwardly from said steering handlebar of said housing to said back panel of said housing so as to form braces of said steering handlebar of said housing;

wherein said gathering assembly comprises a pair of arms;

wherein said pair of arms of said gathering assembly are pivotally attached to said pair of side edges of said base frame of said housing, respectively, so as to have:

a) in-use positions; and b) stored positions;

wherein said pair of arms of said gathering assembly extend forwardly and outwardly on the ground for gathering the tennis balls on the ground when said pair of arms of said gathering assembly are in said in-use positions thereof and said cart is pushed forwardly by the user;

wherein said pair of arms of said gathering assembly extend upwardly against said receptacle when said pair of arms of said gathering assembly are in said stored positions thereof;

wherein each arm of said gathering assembly has:

a) a proximal portion; and b) a distal portion;

wherein said proximal portion of each arm of said gathering assembly extends pivotally and obliquely from an associated side edge of said base frame of said housing;

wherein said distal portion of each arm of said gathering assembly extends forwardly from said proximal portion of an associated arm of said gathering assembly;

wherein said gathering assembly comprises a pair of shafts;

wherein said pair of shafts of said gathering assembly pass rotatably through said pair of side edges of said base frame of said housing, respectively, from proximal ends thereof to terminal distal ends thereof, respectively;

wherein said gathering assembly comprises a pair of pedals; and wherein said pair of pedals of said gathering assembly are affixed to said proximal ends of said pair of shafts of said gathering assembly, respectively, and are positioned upwardly when said pair of arms of said gathering assembly are in said in-use positions thereof, and when stepped down upon by the user, become positioned sidewardly so as to be in said stored positions thereof.

2. The cart of claim 1, wherein said proximal portion of each arm of said gathering assembly are fixedly attached to said terminal distal ends of the pair of shafts of said gathering assembly, respectively, and rotate therewith.

3. The cart of claim 2, wherein said gathering assembly comprises a pair of wheels.

4. The cart of claim 3, wherein said pair of wheels of said gathering assembly depend rotatably from said distal portion of each arm of said gathering assembly, respectively; and wherein said pair of wheels of said gathering assembly are for rolling on the ground when said pair of arms of said gathering assembly are in said in-use positions thereof.

5. The cart of claim 4, wherein said gathering assembly comprises a pair of magnets.

6. The cart of claim 5, wherein said pair of magnets of said gathering assembly are disposed on said receptacle; and wherein said pair of magnets of said gathering assembly hold said pair of arms of said gathering assembly up when said pair of arms of said gathering assembly are in said stored positions thereof.

7. The cart of claim 6, wherein said conveyor assembly comprises an upper axle.

8. The cart of claim 7, wherein said upper axle of said conveyor assembly is horizontally oriented;

wherein said upper axle of said conveyor assembly is contained rotatably within said housing; and wherein said upper axle of said conveyor assembly is disposed just below said top panel of said housing.

9. The cart of claim 8, wherein said conveyor assembly comprises a lower axle.

10. The cart of claim 9, wherein said lower axle of said conveyor assembly is horizontally oriented;

wherein said lower axle of said conveyor assembly is contained rotatably within said housing;

wherein said lower axle of said conveyor assembly is disposed just above said base frame of said housing; and wherein said lower axle of said conveyor assembly is disposed behind said upper axle of said conveyor assembly.

11. The cart of claim 10, wherein said conveyor assembly comprises a pair of rear wheels.

12. The cart of claim 11, wherein said pair of rear wheels of said conveyor assembly are operatively connected to said lower axle of said conveyor assembly;

wherein said pair of rear wheels of said conveyor assembly rotate independently of each other so as to function as a differential and allow said cart to turn; and wherein said pair of rear wheels of said conveyor assembly are for rolling on the ground when the user pushes said cart.

13. The cart of claim 12, wherein said conveyor assembly comprises a conveyor belt.

14. The cart of claim 13, wherein said conveyor belt of said conveyor assembly is endless; and wherein said conveyor belt of said conveyor assembly reeves around both said upper axle of said conveyor assembly and said lower axle of said conveyor assembly.

15. The cart of claim 14, wherein said conveyor belt of said conveyor system has a plurality of scooping shelves.

16. The art of claim 15, wherein said plurality of scooping shelves of said conveyor belt of said conveyor system are horizontally oriented;

wherein said plurality of scooping shelves of said conveyor belt of said conveyor system are spaced-apart from each other along the conveyor belt of the conveyor system; and wherein said plurality of scooping shelves of said conveyor belt of said conveyor system are for scooping and lifting the tennis balls from said gathering assembly up and into said receptacle.

17. The cart of claim 16, wherein said conveyor assembly comprises a pair of double ratchet assemblies.

18. The cart of claim 17, wherein said pair of double ratchet assemblies of said conveyor assembly are not operatively connected to each other so as to work independently of each other;

wherein said lower axle of said conveyor assembly has a pair of ends; and wherein each double ratchet assembly of said conveyor assembly is operatively connected to and between an associated end of said lower axle of said conveyor assembly and an associated rear wheel of said conveyor assembly.

19. The cart of claim 18, wherein each double ratchet assembly of said conveyor assembly comprises a ratchet ring.

20. The cart of claim 19, wherein said ratchet ring of each double ratchet assembly of said conveyor assembly has:

a) interior peripheral teeth; and b) exterior peripheral teeth.

21. The cart of claim 20, wherein said interior peripheral teeth of said ratchet ring of each double ratchet assembly of said conveyor assembly face oppositely to said exterior peripheral teeth of said ratchet ring of each double ratchet assembly of said conveyor assembly.

22. The cart of claim 21, wherein each double ratchet assembly of said conveyor assembly comprises:

a) an interior pawl; and b) an exterior pawl.

23. The cart of claim 22, wherein said interior pawl of each double ratchet assembly of said conveyor assembly interacts with said interior peripheral teeth of said ratchet ring of an associated double ratchet assembly of said conveyor assembly, and in so doing, connects an associated rear wheel of said conveyor assembly to said lower axle of said conveyor assembly so as to allow said conveyor assembly to operate when either rear wheel of said conveyor assembly rotate by virtue of being rolled on the ground when pushed by the user.

24. The cart of claim 23, wherein said exterior pawl of each double ratchet assembly of said conveyor assembly interacts with said exterior peripheral teeth of said ratchet ring of an associated double ratchet assembly of said conveyor assembly, and in so doing, prevents said lower axle of said conveyor assembly from rotating backwards.

25. The card of claim 24, wherein said receptacle comprises:

a) a lower portion;

b) an upper portion; and c) a lid.

26. The cart of claim 25, wherein said lower portion of said receptacle is rectangular-parallelepiped-shaped;

wherein said lower portion of said receptacle abuts against said front panel of said housing; and wherein said lower portion of said receptacle has an open top.

27. The cart of claim 26, wherein said upper portion of said receptacle is trapezoidal-shaped;

wherein said upper portion of said receptacle sits on top of said lower portion of said receptacle; and wherein said upper portion of said receptacle has:

a) an open bottom; and b) an open top.

28. The cart of claim 27, wherein said open top of said lower portion of said receptacle communicates with said open bottom of said upper portion of said receptacle.

29. The cart of claim 28, wherein said lid of said receptacle is wedge-shaped;

wherein said lid of said receptacle is hingedly attached by hinges to said open top of said upper portion of said receptacle; and wherein said lid of said receptacle selectively closes said open top of said upper portion of said receptacle.

30. The cart of claim 29, wherein said lid of said receptacle has a range of motion; and wherein said range of motion of said lid of said receptacle is from said open top of said upper portion of said receptacle to against said upper portion of said receptacle.

31. The cart of claim 30, wherein said lid of said receptacle communicates with said through slot of said front panel of said housing for directing the tennis balls from said through slot of said front panel of said housing into said upper portion of said receptacle.

32. The cart of claim 31, wherein said receptacle comprises a pair of front wheels.

33. The cart of claim 32, wherein said pair of front wheels of said receptacle depend from said lower portion of said receptacle; and wherein said pair of front wheels of said receptacle are for rolling on the ground when said cart is pushed by the user.

34. The cart of claim 33, wherein each hinge of said receptacle has:

a) a pin part; and b) a non-pin part.

35. The cart of claim 34, wherein said non-pin part of each hinge of said receptacle are disposed along said upper portion of said receptacle, while said pin part of each hinge of said receptacle are disposed along said lid of said receptacle so as to allow said lid of said receptacle to be removed from said upper portion of said receptacle by merely sliding said lid of said receptacle sideways.

* * * * *